US007028438B2

(12) United States Patent
Burdic

(10) Patent No.: US 7,028,438 B2
(45) Date of Patent: Apr. 18, 2006

(54) ROOFING SYSTEM AND METHOD

(75) Inventor: Brad C. Burdic, Littleton, CO (US)

(73) Assignee: Johns Manville, Denver, CO (US)

( * ) Notice: Subject to any disclaimer, the term of this patent is extended or adjusted under 35 U.S.C. 154(b) by 131 days.

(21) Appl. No.: 10/188,940

(22) Filed: Jul. 3, 2002

(65) Prior Publication Data

US 2004/0003563 A1 Jan. 8, 2004

(51) Int. Cl.
*E04B 5/00* (2006.01)

(52) U.S. Cl. ..... 52/409; 52/410; 52/506.05; 52/509; 52/105; 52/404.2

(58) Field of Classification Search ..... 52/105, 52/409, 410, 404.2, 506.05, 509, 512, 292, 52/295, 403.1, 404.4, 404.3
See application file for complete search history.

(56) References Cited

U.S. PATENT DOCUMENTS

| | | | | |
|---|---|---|---|---|
| 2,187,087 | A * | 1/1940 | Leary | 33/758 |
| 3,878,658 | A * | 4/1975 | Davis et al. | 52/410 |
| 4,284,447 | A * | 8/1981 | Dickens et al. | 156/78 |
| 4,382,353 | A * | 5/1983 | Kelly | 52/506.05 |
| 4,437,283 | A * | 3/1984 | Benoit | 52/410 |
| 4,706,432 | A * | 11/1987 | Fishburn | 52/407.1 |
| 4,718,211 | A * | 1/1988 | Russell et al. | 52/409 |
| 4,885,887 | A * | 12/1989 | Simmons et al. | 52/410 |
| 4,927,696 | A * | 5/1990 | Berg | 428/195.1 |
| 5,349,804 | A * | 9/1994 | Van Erden et al. | 52/746.11 |
| 5,469,671 | A * | 11/1995 | Rathgeber et al. | 52/58 |
| 5,740,647 | A * | 4/1998 | Kelly | 52/408 |
| 6,205,730 | B1 * | 3/2001 | Hasan et al. | 52/408 |
| 6,439,519 | B1 * | 8/2002 | Takamasa | 248/188.8 |

FOREIGN PATENT DOCUMENTS

| | | | |
|---|---|---|---|
| DE | 3422643 | A1 * | 12/1985 |
| FR | 2602810 | A1 * | 2/1988 |

* cited by examiner

*Primary Examiner*—Jeanette E. Chapman
(74) *Attorney, Agent, or Firm*—Robert D. Touslee

(57) ABSTRACT

A roofing system for a roof deck able to retain mechanical fasteners includes a layer of roof insulation boards overlaying the roof deck and a plurality of spaced apart hold-down straps overlaying the roof insulation boards. The hold-down straps have pre-formed mechanical fastener openings therethrough on preselected center to center spacings and mechanical fasteners pass down through the mechanical fastener openings in the hold-down straps, through the roof insulation boards, and into the roof deck to secure the roof insulation boards to the roof deck. Preferably, the roof insulation boards each have guidelines thereon for placement of the hold-down straps relative to the roof insulation board.

10 Claims, 2 Drawing Sheets

ROOFING SYSTEM AND METHOD

BACKGROUND OF THE INVENTION

The subject invention relates to a roofing system for roof decks that are able to retain mechanical fasteners, and in particular to an insulated roofing system and method of constructing the insulated roofing system that utilizes unique hold-down straps to secure the roof insulation to the roof deck. The invention is especially suited for use in EPDM, PVC, and TPO membrane roofing systems, modified bitumen roofing systems, and built-up roofing systems utilizing multiple layers of bitumen and roofing felts.

Industrial, commercial, and similar buildings typically have low slope roof decks. The two major types of industrial/commercial roofing systems utilized on these roof decks are single ply roofing membrane systems and built-up roofing systems that include multiple layers of bitumen and roofing felts. Normally, these roofing systems include roof insulation boards that are located beneath the membrane or bitumen and felt layers of the roofing system and over the roof deck. The typical roof insulation boards used to insulate these roofing systems are 4×8 foot, 4×4 foot, 3×4 foot and 2×4 foot expanded perlite, fiberglass, wood fiber, and closed or open cell foam insulation boards. An example of 2×4 foot and 4×4 foot, 0.75 to 2.0 inch thick, expanded perlite insulation board that may be used as the insulation board in such systems is an expanded perlite insulation board sold by Johns Manville International, Inc. under the trade designation Fesco® Board Roof Insulation. An example of 4×4 foot and 4×8 foot, 1.0 to 4.0 inch thick closed cell foam insulation board that may be used as the insulation board in such systems is a closed cell polyisocyanurate foam core board sold by Johns Manville International, Inc. under the trade designation UltraGard® ISO 1,2,3™ Roof Insulation. An example of a gypsum insulation board is a gypsum insulation board sold by Georgia-Pacific Corporation under the trade designation Dens-Deck® glass mat gypsum roof board.

Many roof decks, including but not limited to steel, wood, and lightweight concrete roof decks, can accept and retain conventional mechanical fasteners. When insulated single ply roofing membrane systems and insulated built-up roofing systems are being installed over roof decks that can accept and retain conventional mechanical fasteners, the roof insulation boards are normally secured to the roof deck with mechanical fasteners. To conform to industry standards, such as Factory Mutual standards, Underwriters laboratories, Inc. standards and code agency standards for wind-resistant systems (systems that can withstand certain specified wind velocities without uplift of the roof insulation boards or the fasteners pulling-through the roof insulation boards), these 4×8 foot, 3×4 foot, 4×4 foot, and 2×4 foot expanded perlite, fiberglass, wood fiber, and foam roof insulation boards are typically secured to the roof deck with up to 24 conventional mechanical fasteners per roof insulation board. While this system for securing the roof insulation boards to roof decks works well, the system has two drawbacks. The relatively large number of mechanical fasteners required to anchor the roof insulation boards to achieve wind-resistant systems that meet industry standards and the time required to install the roof insulation boards utilizing such a relatively large number of mechanical fasteners are costly to the contractor and building owner. Accordingly, there has been a need for a system to anchor roof insulation boards to a roof deck that can be assembled more quickly with fewer mechanical fasteners while providing equal or greater wind uplift resistance.

SUMMARY OF THE INVENTION

The roof insulation board hold-down system of the subject invention provides a system for anchoring roof insulation boards to a roof deck that can be assembled more quickly with fewer mechanical fasteners than the fastening system discussed above. In addition, it is believed that the roof insulation board hold-down system of the subject invention may also be able to provide increased wind uplift resistance by creating greater surface area to resistant mechanical fastener pull-through. The roof insulation board hold-down system of the subject invention includes a layer of roof insulation boards overlaying the roof deck and a plurality of spaced apart hold-down straps overlaying the roof insulation boards. The hold-down straps have preformed mechanical fastener openings therethrough on preselected center to center spacings and mechanical fasteners pass down through the mechanical fastener openings in the hold-down straps, through the roof insulation boards, and into the roof deck to secure the roof insulation boards to the roof deck. With their mechanical fastener openings, the hold-down straps also function as templates for accurately placing the mechanical fasteners in the roof insulation boards and for enabling a foreman or building inspector to easily check the installation to assure that the correct number of mechanical fasteners has been used in the installation to meet a particular industry standard.

Preferably, the roof insulation boards each have guidelines on their upper major surfaces for placement of the hold-down straps relative to the roof insulation boards. The guidelines can indicate where the hold-down straps should be installed relative to the roof insulation boards when the roof insulation boards are located along a peripheral edge of the roof deck, at a corner of the roof deck, or in a central portion of the roof deck defined by the inner edges of the roof insulation boards installed along the peripheral edges of the roof deck and at the corners of the roof deck. By following the guidelines, the hold-down straps can be accurately located over the roof insulation boards on a deck along the perimeter of the roof deck, at the corners of the roof deck, and in the central portion of the roof deck to assure that the roof insulation boards are being effectively held in place to resist wind uplift. In a typical roofing system, a single ply roofing membrane system, a modified bitumen roofing system, or a built-up roofing system overlays the layer of roof insulation boards.

DESCRIPTION OF THE PREFERRED EMBODIMENTS

Figure 1:
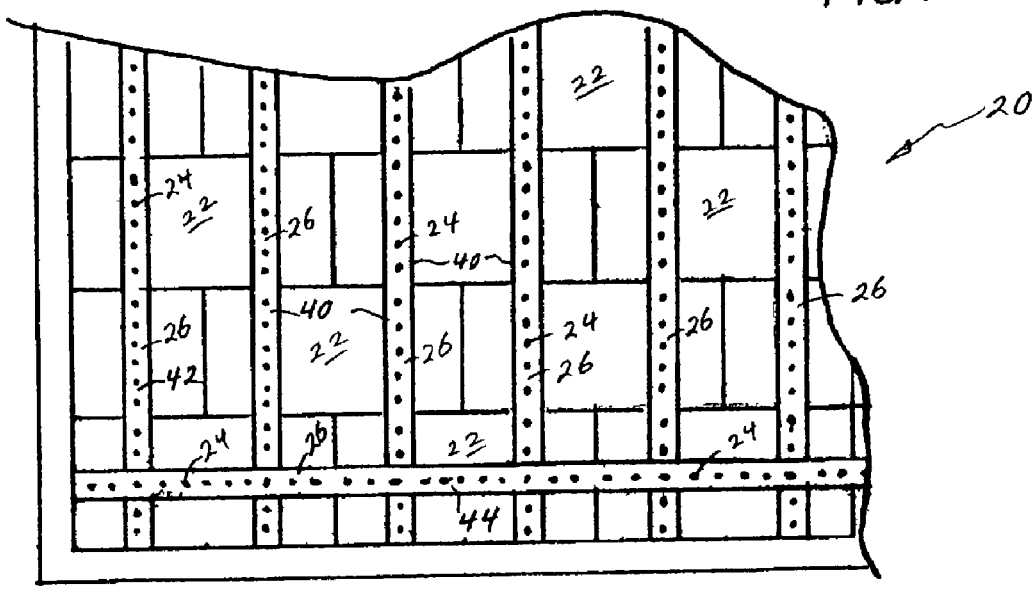
FIG. 1 is a schematic plan view of a roof with the roof insulation boards secured to the roof deck with the roof insulation board hold-down system of the subject invention.

FIG. 1 illustrates a typical installation of the roof insulation board hold-down system 20 of the subject invention. With the roof insulation board hold-down system 20, a layer of roof insulation boards 22 overlaying a roof deck is secured to the roof deck by conventional mechanical fasteners 24 passing through a plurality of spaced apart hold-down straps 26 overlaying the roof insulation boards. The roof insulation boards 22 secured to the roof deck by the roof insulation board hold-down system 20 are typically part of a roofing system that includes a single ply roofing membrane system, a modified bitumen roofing system, or a built-up roofing system.

Preferably, the roof insulation boards 22 used to insulate the roof decks and secured to the roof decks by the roof insulation board hold-down system 20 are 4×8 foot, 4×4 foot, 3×4 foot and 2×4 foot fiberglass insulation boards, expanded perlite insulation boards, and wood fiber insulation boards about 0.75 inches to about 2.00 inches in thickness or closed or open cell foam insulation boards between 0.75 and 4 inches in thickness. An example of 2×4 foot and 4×4 foot expanded perlite insulation board that may be used as the insulation board in such systems is an expanded perlite insulation board sold by Johns Manville International, Inc. under the trade designation Fesco® Board Roof Insulation. An example of 4×4 foot and 4×8 foot closed cell foam insulation board that may be used as the insulation board in such systems is a closed cell polyisocyanurate foam core board sold by Johns Manville International, Inc. under the trade designation UltraGard® ISO 1, 2, or 3™ Roof Insulation. While these roof insulation boards are preferred, it is contemplated that other roof insulation boards used in roofing systems could be secured to roof decks with the roof insulation board hold-down system 20. An example of such an insulation board is a gypsum insulation board sold by Georgia-Pacific Corporation under the trade designation Dens-Deck® glass mat gypsum roof board.

Preferably, the hold-down straps 26 are between 6 inches and 8 inches in width to provide greater surface area resistance with fewer mechanical fasteners than hold-down systems utilizing only mechanical fasteners and superior wind uplift resistance over hold-down systems utilizing only mechanical fasteners. Preferably, the hold-down straps 26 are shipped, stored and dispensed from rolls containing about 100 to 200 feet of the hold-down strap. The rolls of hold-down strap 26 may be mounted on spools and dispensed from a dispenser (not shown) having an automatic cut off device that cuts the hold-down strap 26 being dispensed when the hold-down strap being dispensed reaches a selected length.

Figure 2:
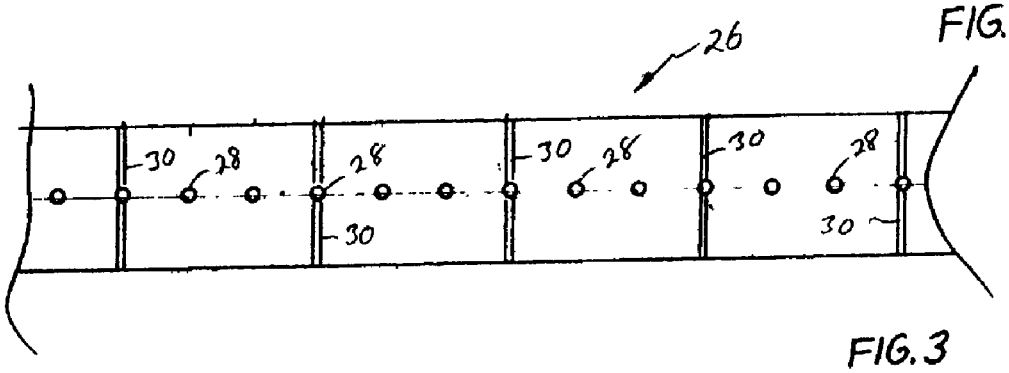
FIG. 2 is view of a portion of a hold-down strap of the subject invention.

As shown in FIG. 2, the hold-down straps 26 have pre-formed mechanical fastener openings 28 therethrough on preselected center-to-center spacings. Preferably, the pre-formed mechanical fastener openings 28 are aligned along the longitudinal centerline of the hold-down straps 26 and, while other center-to-center spacings may be used to best suit the application, such as but not limited to 16 inch or 24 inch spacings, the preferred center-to-center spacing for the pre-formed mechanical fastener openings 28 in the hold down straps 26 is 8 inches. With center-to-center spacings of 8 inches for the mechanical fastener openings 28, if desired for a particular application, fastener spacings of 16 inches or 24 inches can be easily obtained by placing fasteners through every second or every third mechanical fastener opening 28. The mechanical fastener openings 28 are pre-punched or otherwise pre-formed in the hold-down straps 26 during the manufacture of the hold-down straps 26 so that the mechanical fastener openings 28 do not have to be formed in the hold-down straps at the job site. Preferably, the edges of the mechanical fastener openings 28 are reinforced to prevent the tearing of the hold-down strips or mechanical fastener pull through when the roof insulation boards being held down by the hold-down straps are subjected to wind uplift.

The hold-down straps 26 may be made of glass fibers, polyester fibers or other polymeric reinforcement materials and blends of such materials. Where the hold-down straps 26 are to be used in a single ply roofing membrane system where a roofing membrane is bonded by a layer of cement to upper surfaces of the roof insulation boards 22, preferably, the hold-down straps 26 are chemically compatible with the cement and the roofing membrane so that no chemical reaction takes place between the hold-down straps 26 and the cement and roofing membrane that would adversely affect the hold-down straps, the cement or the roofing membrane in any appreciable manner. Where the hold-down straps 26 are to be used in a single ply roofing membrane system where the membrane is secured to the deck with conventional mechanical fasteners used in the roofing industry or held in place with ballast, preferably, the hold-down straps 26 are chemically compatible with the roofing membrane so that no chemical reaction takes place between the hold-down straps 26 and the roofing membrane that would adversely affect the hold-down straps or the roofing membrane in any appreciable manner. Examples of single ply roofing membrane systems are PVC, TPO and EPDM membrane systems.

Where the hold-down straps 26 are to be used in a modified bitumen roofing system or a built-up roofing system (a roofing system where roofing felts or membranes are secured to upper surfaces of the roof insulation boards 22 with a bitumen coating that overlays the roof insulation boards 22 and hold-down straps and is applied to the roof insulation boards and hold-down straps at temperatures typically ranging from 275° F. to 525° F.), the hold-down straps 26 are chemically compatible with the bitumen coating and roofing felts or membranes so that no chemical reaction takes place between the hold-down straps and the bitumen coating and roofing felts or membranes that would adversely affect the hold-down straps, the bitumen coating or the roofing felts or membranes in any appreciable manner. In addition, the hold-down straps 26 can withstand a temperature equal to or exceeding the temperature at which the bitumen layer(s) are applied without adversely affecting the strength of the hold-down straps in any appreciable manner, e.g. temperatures ranging from at least 275° F. to 525° F. Examples of modified bitumen roofing systems are roofing systems using membranes made from nonwoven polyester or glass fiber reinforcements combined with an elastomeric blend of asphalt and styrene-butadiene-styrene rubber or asphalt and atactic polypropylene. An example of a built-up roofing system is a roofing system formed from layers of a waterproofing bitumen alternating with plies of reinforcing felts.

Since the hold-down straps 26 have pre-formed mechanical fastener openings 28 therein on pre-selected center-to-center spacings, e.g. 8 inch center-to-center spacings, the hold-down straps 26 provide a template for the accurate installation of the mechanical fasteners 24 that pass down through the mechanical fastener openings 28 in the hold-down straps, through the roof insulation boards 22, and into the roof deck to secure the roof insulation boards to the roof deck. With their mechanical fastener openings 28, the hold-down straps 26 also enable a foreman or building inspector to easily check the installation to assure that the correct number of mechanical fasteners has been used in the installation to meet a particular industry standard. Depending on the application and the wind uplift standard to be met, mechanical fasteners may be installed through every mechanical fastener opening 28 in a hold-down strap 26 or only through pre-selected mechanical fastener openings 28, e.g. through every second or every third mechanical fastener opening.

To assist the installer with the placement of the mechanical fasteners 24 through a hold-down strap 26, the hold down strap 26 may be marked on its upper surface to indicate the distances between at least some of the mechanical fastener openings 28. As shown in FIG. 2, the hold-down strap 26 has a transverse stripe 30 passing through every third mechanical fastener opening 28. Where the mechanical fastener openings 28 in the hold-down strap 26 are on 8-inch center-to-center spacings, the marking of every third mechanical fastener opening 28 with a stripe 30 would mark off 2 feet of hold-down strap. While mechanical fastener opening markings 30 measuring the hold-down strap 26 in feet have been used as an example, it is contemplated that markings could be included on the upper surface of the hold-down straps 26 as a measurement of other distances that might assist the installer in the installation of the hold-down strap. While the mark shown is a stripe 30, other means of marking the hold-down strap 26 to measure distances may be used, such as but not limited to, the graduations used on or similar to the graduations used on a conventional measuring tape that may include numerical notations. The mark may be any color provided it contrasts with the surface of the tape to be easily read and different color stripes could be used to indicate different distances along the lengths of the hold-down straps 26.

Preferably, the upper major surfaces 32 of the roof insulation boards 22 each have guidelines thereon for placement of the hold-down straps 26 relative to the roof insulation boards. The guidelines can indicate where the hold-down straps 26 should be installed relative to the roof insulation boards 22 when the roof insulation boards are located along a peripheral edge of the roof deck, at a corner of the roof deck, or in a central portion of the roof deck (a portion of the roof deck defined by the inner edges of the perimeter roof insulation boards installed along the peripheral edges of the roof deck and at the corners of the roof deck). By following the guidelines, the hold-down straps 26 can be accurately located over the roof insulation boards on a deck: a) along the perimeter of the roof deck; b) at the corners of the roof deck; and c) in the central portion of the roof deck to assure that the roof insulation boards 22 are being effectively held in place to resist wind uplift and meet selected wind-uplift resistance standards.

Figure 3:
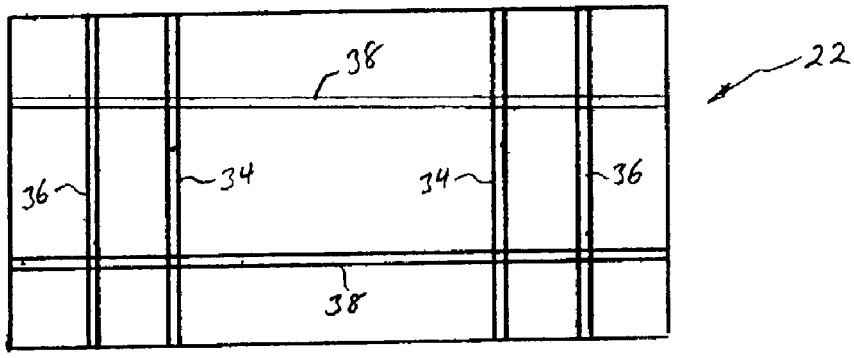
FIG. 3 is a top view of a roof insulation board of roof insulation system of the subject invention.

The guidelines on the roof insulation board 22 shown in FIG. 3 are an example of guidelines on the upper surface of the roof insulation boards that may be used on the roof insulation boards to locate the placement of the hold-down straps 26. The roof insulation board 22 of FIG. 3 has a first pair of parallel guidelines 34 and a second pair of parallel guidelines 36 that may be used to locate hold-down straps 26 passing from an outer peripheral edge of a roof over perimeter roof insulation boards located along the peripheral edge of the roof as well as over roof insulation boards (typically called field insulation boards) in a central portion of the roof (the portion of the roof that is defined by the inner edges of the perimeter roof insulation boards on the roof). Depending on the application, the first and second pairs of guidelines 34 and 36 may also be used for locating a hold-down strap 26 adjacent a peripheral edge of a roof when the roof insulation board 22 is located along a peripheral edge or corner the roof deck. The roof insulation board 22 of FIG. 3 also includes a third pair of parallel guidelines 38 for locating a hold-down strap 26 adjacent a peripheral edge of a roof when the roof insulation board is located along a peripheral edge or corner of a roof deck. By way of example, where the roof insulation board 22 is a 4×8 foot roof insulation board, the parallel guidelines 34 may be spaced inward from opposite the ends of the roof insulation board 8 inches, 16 inches or 24 inches, the parallel guidelines 36 may be spaced inward from opposite the ends of the roof insulation board 8 inches or 16 inches, and the parallel guidelines 38 may be spaced inward from opposite the sides of the roof insulation board 8 inches or 16 inches or only one guideline 38 may be spaced inward from opposite sides of the roof insulation board 24 inches.

Where roof insulation boards 22 with the guidelines are used to locate the hold-down straps 26, the hold-down straps designated 40 in FIG. 1, are examples of hold-down straps 26 that are located using either of the pairs of parallel guidelines 34 or 36 on the roof insulation boards. Where roof insulation boards 22 with guidelines are used to locate the hold-down straps 26, the hold-down strap designated 42 in FIG. 1 is an example of a hold-down strap 26 that is located using one of the parallel guidelines 34 or 36 on the roof insulation boards. Where roof insulation boards 22 with guidelines are used to locate the hold-down straps 26, the hold-down strap designated 44 in FIG. 1 is an example of a hold-down strap that is located using one of the guidelines 38 on the roof insulation boards. The guidelines can be marked onto or scored into the upper major surfaces of the roof insulation boards 22. The pairs of guidelines 34, 36 and 38 can be made so that the different pairs of guidelines can be distinguished from each other, e.g. different colors, or solid line, dotted line and dashed line.

Figure 4:
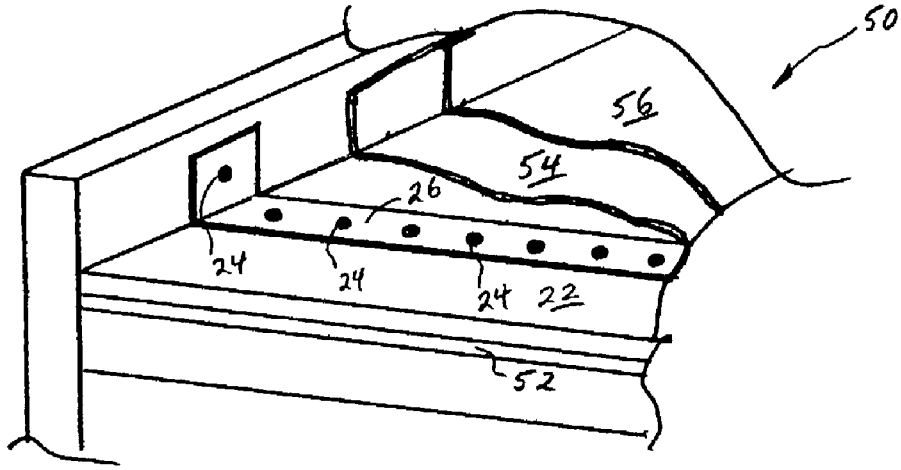
FIG. 4 is a schematic vertical cross section through a portion of a single ply roofing membrane system utilizing the roof insulation system of the subject invention overlaid with a conventional single ply roofing membrane.

FIG. 4 illustrates a portion of a typical single ply roofing membrane system 50 with portions broken away to better illustrate the different layers of the system. As shown, a layer of roof insulation boards 22 overlay the roof deck 52 and a plurality of spaced apart hold-down straps 26 (only one of which is shown) overlay the roof insulation boards. The roof deck 52 may be a steel, wood, lightweight concrete or other conventional roofing substrate that is able to receive and retain conventional mechanical fasteners 24 commonly used in the industry such as but not limited to roofing nails, screws, etc. The mechanical fasteners 24 pass down through the mechanical fastener openings 28 in the hold-down straps 26, through the roof insulation boards 22, and into the roof deck 52 to secure the roof insulation boards to the roof deck. As shown a layer of cement 54 covers the upper surfaces of the roof insulation boards 22 and bonds a single ply membrane 56 to the upper surfaces of the roof insulation boards 22. However, rather than cementing the membrane 56 in place, the membrane 56 may be secured to the deck with conventional mechanical fasteners used in the roofing industry or held in place with ballast.

Figure 5:
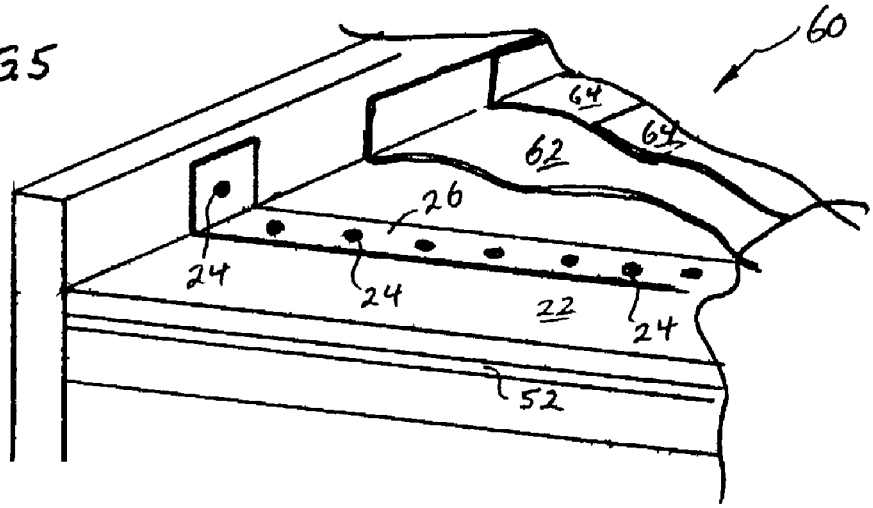
FIG. 5 is a schematic vertical cross section through a portion of a built-up roofing system utilizing the roof insulation system of the subject invention overlaid with layers of bitumen and roofing felts.

FIG. 5 illustrates a portion of a typical modified bitumen or built-up roofing system 60 with portions broken away to better illustrate the different layers of the system. As shown, a layer of roof insulation boards 22 overlay the roof deck 52 and a plurality of spaced apart hold-down straps 26 (only one of which is shown) overlay the roof insulation boards. The roof deck 52 may be a steel, wood, lightweight concrete or other conventional roofing substrate that is able to receive and retain conventional mechanical fasteners 24 commonly used in the industry such as but not limited to roofing nails, screws, etc. The mechanical fasteners 24 pass down through the mechanical fastener openings 28 in the hold-down straps 26, through the roof insulation boards 22, and into the roof deck 52 to secure the roof insulation boards to the roof deck. A layer of bitumen 62 covers the upper surfaces of the roof insulation boards 22 and bonds a roofing felt(s) or membrane(s) 64 to the upper surfaces of the roof insulation boards 22.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A roofing system, comprising:

a roof deck able to retain mechanical fasteners; the roof deck having peripheral edges and corners;

roof insulation boards overlaying the roof deck; seams formed between the roof insulation boards where the roof insulation boards abut each other;

a plurality of hold-down straps extending in a first direction, overlaying, and in direct contact with the roof insulation boards; the hold down straps being located on the roof insulation boards so that the hold down straps are not overlaying and longitudinally aligned with the seams formed between the roof insulation boards; the hold-down straps being spaced from each other in a direction perpendicular to the first direction; the hold-down straps having pre-formed mechanical fastener openings therethrough on preselected center to center spacings;

peripheral edge hold-down straps overlaying and in direct contact with the roof insulation boards extending along each peripheral edge of the roof deck; each peripheral edge hold-down strap extending parallel to and being spaced inwardly from an adjacent peripheral edge of the roof deck; the peripheral edge hold-down straps having pre-formed mechanical fastener openings therethrough on preselected center to center spacings; and mechanical fasteners passing down through the mechanical fastener openings in the hold-down straps and the peripheral edge hold-down straps, through the roof insulation boards, and into the roof deck to secure the roof insulation boards to the roof deck.

2. The roofing system according to claim 1, wherein:

the peripheral edge hold-down straps of successive peripheral edges of the roof deck cross each other at the corner of the roof deck intermediate the successive peripheral edges of the roof deck.

3. The roofing system according to claim 1, wherein:

each roof insulation board has guidelines thereon for placement of the hold-down straps relative to the roof insulation board.

4. The roofing system according to claim 1, wherein:

the roof insulation boards as laid on the roof deck include peripheral edge roof insulation boards that are located along peripheral edges of the roof deck, corner roof insulation boards that are located at the corners of the roof deck, and field roof insulation boards located within an area defined by inner edges of the peripheral edge and corner roof insulation boards; and each of the roof insulation boards has one or more first guidelines thereon for placement of the hold-down straps relative to the roof insulation board when the roof insulation board is used as a field roof insulation board.

5. The roofing system according to claim 4, wherein:

each of the roof insulation boards has one or more second guideline thereon for placement of the hold-down straps relative to the roof insulation board when the roof insulation board is used as a peripheral edge roof insulation board.

6. The roofing system according to claim 5, wherein:

each of the roof insulation boards has one or more third guidelines thereon for placement of the hold-down straps relative to the roof insulation board when the roof insulation board is used as a corner roof insulation board.

7. The roofing system according to claim 6, wherein:

for each of the roof insulation boards, the one or more first guidelines for placement of the hold-down straps when the roof insulation board is used as a field roof insulation board are a first color; the one or more second guidelines for placement of the hold-down straps when the roof insulation board is used as a peripheral edge roof insulation board are a second color; and the one or more third guidelines for placement of the hold-down straps when the roof insulation board is used as a corner roof insulation board are a third color.

8. The roofing system according to claim 6, wherein:

for each of the roof insulation boards, the one or more first guidelines for placement of the hold-down straps when the roof insulation board is used as a field roof insulation board have a first distinguishing characteristic; the one or more second guidelines for placement of the hold-down straps when the roof insulation board is used as a peripheral edge roof insulation board have a second distinguishing characteristic; and the one or more third guidelines for placement of the hold-down straps when the roof insulation board is used as a corner roof insulation board have a third distinguishing characteristic whereby the first, second and third guidelines can be distinguished from each other.

9. The roofing system according to claim 1, wherein:

a roofing membrane is bonded by a cement to upper surfaces of the roof insulation boards; and the hold-down straps are chemically compatible with the cement and the roofing membrane so that no chemical reaction takes place between the hold-down straps and the cement and roofing membrane that would adversely affect the hold-down straps, the cement, or the roofing membrane.

10. The roofing system according to claim 1, wherein:

a roofing felt or membrane is secured to upper surfaces of the roof insulation boards with a bitumen coating that overlays the roof insulation boards and is applied to the roof insulation boards at temperatures in excess of 275° F.; the hold-down straps are made of glass fibers, polymeric fibers, or blends of glass and polymeric fibers that are chemically compatible with the bitumen coating and the roofing felt or membrane so that no chemical reaction takes place between the hold-down straps and the bitumen coating or the roofing felt or membrane that would adversely affect the hold-down straps, the bitumen coating or the roofing felt or membrane; and the hold-down straps can withstand a temperature of at least 275° F. without adversely affecting the hold-down straps.

* * * * *